US006678985B2

(12) United States Patent
Pikula

(10) Patent No.: US 6,678,985 B2
(45) Date of Patent: Jan. 20, 2004

(54) MAGAZINE CLIP—CARTRIDGE LOADING TRAY

(76) Inventor: Robert D. Pikula, 116 Johnny Cake La., Glastonbury, CT (US) 06033

( * ) Notice: Subject to any disclaimer, the term of this patent is extended or adjusted under 35 U.S.C. 154(b) by 0 days.

(21) Appl. No.: 10/286,470

(22) Filed: Nov. 1, 2002

(65) Prior Publication Data

US 2003/0093936 A1 May 22, 2003

Related U.S. Application Data

(60) Provisional application No. 60/337,260, filed on Nov. 2, 2001.

(51) Int. Cl.[7] ..... F41A 9/00
(52) U.S. Cl. ..... 42/87
(58) Field of Search ..... 42/87, 88, 89, 42/90, 49.01, 49.02

(56) References Cited

U.S. PATENT DOCUMENTS

| | | | | | |
|---|---|---|---|---|---|
| 869,632 | A | * | 10/1907 | Hockett | 42/88 |
| 2,592,415 | A | * | 4/1952 | Grogan | 294/159 |
| 2,920,893 | A | * | 1/1960 | Walker | 273/348 |
| 3,515,321 | A | * | 6/1970 | Webster | 206/3 |
| 3,744,170 | A | * | 7/1973 | Jensen | 42/87 |
| 3,990,170 | A | * | 11/1976 | Griffis | 42/89 |
| 4,614,052 | A | * | 9/1986 | Brown et al. | 42/87 |
| 5,083,393 | A | * | 1/1992 | Smydas | 42/90 |
| 5,249,386 | A | | 10/1993 | Switzer | 42/87 |

FOREIGN PATENT DOCUMENTS

| | | |
|---|---|---|
| DE | 304379 | 10/1917 |
| GB | 555367 | 8/1943 |

* cited by examiner

*Primary Examiner*—Charles T. Jordan
*Assistant Examiner*—Denise Y Buckley
(74) *Attorney, Agent, or Firm*—McCormick, Paulding & Huber LLP

(57) ABSTRACT

A method and apparatus for loading cartridges into a gun magazine clip from a tray. The cartridges are arranged in tray cavities that hold each cartridge so the clip can be manipulated with one hand to load each cartridge in succession.

6 Claims, 1 Drawing Sheet

MAGAZINE CLIP— CARTRIDGE LOADING TRAY

Applicant hereby claims priority under 35 U.S.C. §119 from Provisional Application No: 60/337,260 filed on Nov. 2, 2001, the disclosure of which is herein incorporated by reference.

BACKGROUND OF THE INVENTION

This invention relates generally to loading individual cartridges or shells into a magazine clip of the type used with automatic weapons, particularly automatic and semiautomatic pistols.

The known method for loading cartridges into a magazine clip is by manually inserting each shell into the open end of the clip by depressing the slug end of the cartridge with the heel or rim end of the next shell so that entry of each of the shells follows in generally reverse motion to that which the shell will ultimately take as it leaves the magazine clip and enters the firing chamber of the pistol.

Such a procedure requires two hands for so loading the magazine clip, a decided disadvantage to those who are capable of firing a pistol once it is loaded, but who are disabled and can only use one hand for this operation.

SUMMARY OF THE INVENTION

In accordance with the present invention for loading cartridges into a conventional magazine clip, a tray is provided with cavities or receptacles for holding each of the individual cartridges to be loaded in side by side relationship. Each cavity includes means for centering the cartridges in each of the cavities, and nevertheless provides sufficient clearance on either side of the cartridge to allow the clip to be forcibly pushed downwardly against the cartridge in the cavity at a slight angle to the orientation of the cavity, that is not normally to the tray but rather at approximately a 70-degree angle thereto. The magazine clip is then used to apply pressure from the heel of the follower provided in the magazine clip or a cartridge that has already been loaded to push the cartridge to be loaded from the tray against the rear of its associated cavity, and to thereby move the follower or the cartridges already in the clip further into the clip to allow space for the cartridge to be loaded to enter the clip itself.

The tray defining the side-by-side cavities for each of the cartridges to be loaded preferably is of elongated rectangular configuration perpendicular to the axes of the various cavities, and preferably includes a non-slip surface on the back surface plus counter sunk openings receive fasteners for securing the tray to the countertop or the like. This later configuration is especially convenient in the environment of a firing range or the like.

It is nevertheless a feature of the present invention that a tray constructed in accordance with the above-described parameters can be conveniently carried about by a disabled marksman who will be able then to load cartridges into his semi-automatic weapon magazine clip using only one hand.

DETAILED DESCRIPTION

Figure 1:
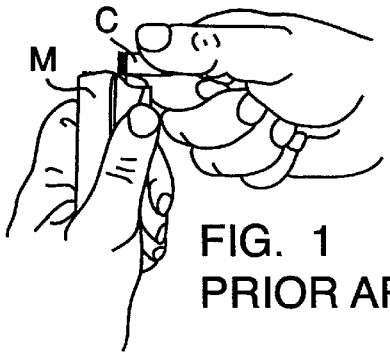
FIG. 1 PRIOR ART
FIG. 1 shows the prior art manual approach to loading cartridges into a semiautomatic weapon magazine clip.

FIG. 1 shows a conventional approach to loading individual cartridges C into a magazine clip M of the type used in present day automatic pistols. The user must grip the magazine clip in one hand, and the cartridge to be loaded in the other, while he applies pressure onto the nose or slug end of a cartridge previously loaded into magazine M by applying a force to that loaded cartridge in an appropriate direction to achieve movement of that cartridge against the bias of an internal spring provided in the magazine until he can slide the cartridge C to be loaded into place. This operation is repeated sequentially until the desired number of cartridges have been loaded into the magazine M. The magazine clip M typically includes a biased follower F that must itself be depressed in the same manner to achieve loading of the first or initial cartridge in accordance with this prior art technique.

Figure 3A:
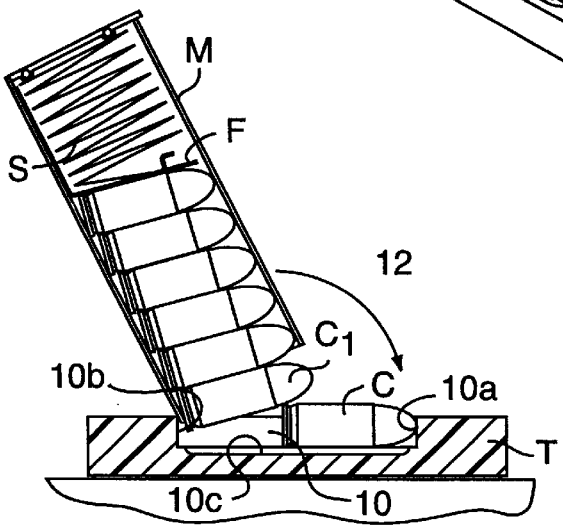
FIG. 3A is an elevational view showing in vertical section, the initial position assumed by the user to prepare for loading a cartridge into the magazine clip.
Figure 3B:
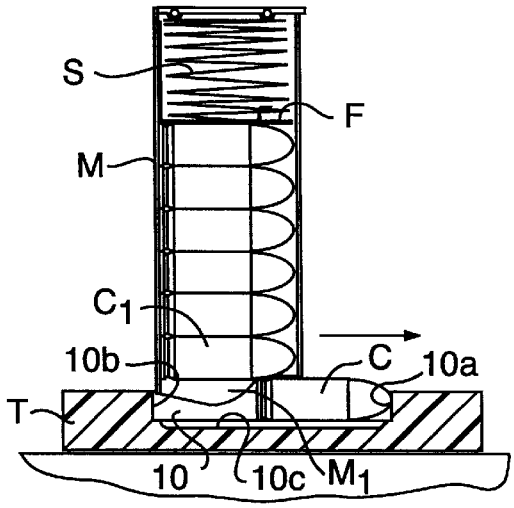
FIG. 3B is a view subsequent to that of FIG. 3A wherein the cartridge is being driven into the magazine clip as a result of the user continuing to exert downward and in the direction of the arrow to drive the cartridge in the clip. Note that the clip is driven toward the user slightly as indicated generally by the arrow "A" in FIG. 3B.

FIGS. 3A and 3B show the magazine clip M and the spring biased follower F. The clip M is gripped by the user who uses the magazine itself as a sort of a handle in carrying out the method of the present invention using the cartridge tray of the present invention.

Figure 2:
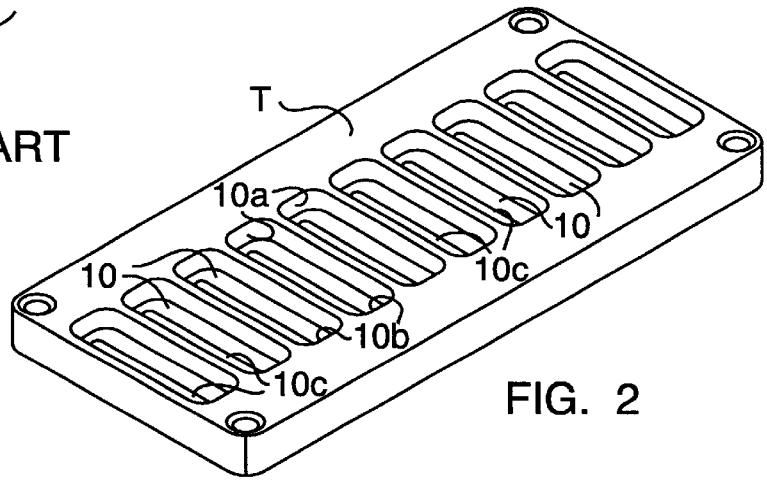
FIG. 2 is a perspective view showing a tray constructed in accordance with the present invention.

FIG. 2 shows a tray T which is preferably fabricated of a high-density polymeric or plastic/synthetic material of the type that exhibits a degree of lubricity. The tray T is formed with a plurality of cartridge-cavities, 10,10 preferably corresponding in number to the number of cartridges to be loaded in the magazine clip M. Each cavity 10 has a forward end 10*a* and a rearward end 10*b*, which are spaced apart from one another, a distance that exceeds the length of the cartridge C to be loaded.

Figure 2A:
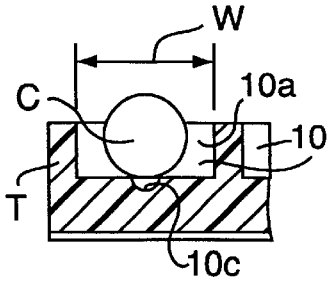
FIG. 2A is a sectional view taken generally on the line 2A of FIG. 2 and showing a cartridge in cavity.

Each of the cavities 10 is somewhat greater in width W than the diameter of the cartridge C as best shown in FIG. 2A. As also shown in FIG. 2A, each of the cavities 10 includes a central groove 10*c* which extends at least approximately the length of the cavity 10 for supporting the cartridges C,C in centered relationship in each of the cavities 10 again as suggested for example in FIG. 2A. The width W is designed to accommodate the width defined by flanges M1, on the clip as suggested in FIG. 3B.

Figure 3C:
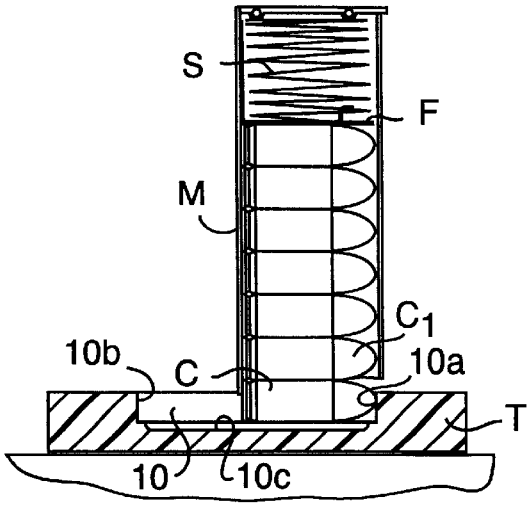
FIG. 3C shows the cartridge loaded into the clip.

Once the user has placed his cartridges in the cavities 10 of the tray T, he can grasp the magazine clip M and hold it in the position shown in FIG. 3A. By applying a downward pulling force as indicated by the arrow 12 in FIG. 3A, the user can with one hand push the rear end of cartridge $C_1$ against the slug end of the cartridge C in the tray T, and thereby displace the cartridge $C_1$ upwardly against the force of the spring S in the magazine clip M. Further pressure in the rearward direction coupled by a slight forward rocking motion as indicated by the arrow 12 in FIG. 3A will result in the cartridge C ultimately assuming the position for the cartridge $C_1$ as suggested in FIG. 3C.

This process can be repeated until all of the cartridges are loaded into the magazine clip, and in accordance with the present invention, only one hand is required to complete this operation.

In light of the above, it is therefor understood that within the scope of the appended claims, the invention may be practiced otherwise then as specifically described.

I claim:

1. A method for loading cartridges into a magazine clip of the type used in automatic weapons, said method comprising:

placing a plurality of cartridges in side-by-side cavities of a tray, centering the cartridges in the cavities with a slug end of each cartridge abutting a rear end of that cavity, and with the cartridges in each cavity spaced laterally from the side walls of the cavity, and grasping the magazine clip in one hand and applying pressure to the rear end of the cartridge in a cavity by engaging the the follower in the magazine, or the end most cartridge in the magazine, with the rear end of the cartridge in the tray, followed by moving the magazine clip toward the user while at the same time rotating the magazine clip slightly in order cause the cartridge in the cavity to be received as the endmost cartridge in the magazine clip.

2. The method according to claim 1 repeated a number of times on a number of cartridges to load a number of cartridges into the magazine clip in sequence.

3. The method according to claim 2 further characterized by providing a non-slip surface on the underside of the tray for securing the tray to an underlying surface in order to assure one-handed operation of the magazine clip as defined above.

4. A tray for supporting a plurality of generally cylindrical and uniformly shaped cartridges, said tray comprising;

a plurality of side-by-side cartridge cavities adapted to receive the cartridges so that the cavities are somewhat longer than the length of each cartridge, and the cavities somewhat wider than the diameter of said cartridges to accommodate the end flanges of a magazine clip, each of said cavities including an elongated groove centered in each of the cavities to assure centering of an associated cartridge therein, said cartridge cavities having a depth at least approximately equal to one-half the diameter of the cartridges.

5. The apparatus according to claim 4 further characterized by a non-slip surface provided on the underside of said tray.

6. The apparatus according to claim 5 wherein said tray is of high-density plastic of the type characterized by a low coefficient of friction to allow each of the cartridges to slide in its associated cavity whereby the magazine clip can be manipulated successively to load the cartridges seriatim into the magazine clip.

* * * * *

UNITED STATES PATENT AND TRADEMARK OFFICE

CERTIFICATE OF CORRECTION

PATENT NO. : 6,678,985 B2
DATED : January 20,2004
INVENTOR(S) : Robert D. Pikula It is certified that error appears in the above-identified patent and that said Letters Patent is hereby corrected as shown below:

Column 3,
Line 12, please delete “the” after the word “engaging”.

Signed and Sealed this

Fifteenth Day of June, 2004

JON W. DUDAS
*Acting Director of the United States Patent and Trademark Office*